US009072360B2

(12) United States Patent
Bueti et al.

(10) Patent No.: US 9,072,360 B2
(45) Date of Patent: Jul. 7, 2015

(54) MULTI-LAYERED COMPACTS WITH ROTATING TIERS

(71) Applicants: Girolama Bueti, Mount Kisco, NY (US); Jason Stockmal, Lafayette, NJ (US)

(72) Inventors: Girolama Bueti, Mount Kisco, NY (US); Jason Stockmal, Lafayette, NJ (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 13/870,162

(22) Filed: Apr. 25, 2013

(65) Prior Publication Data

US 2014/0318569 A1 Oct. 30, 2014

(51) Int. Cl.

| | |
|---|---|
| ***A45D 33/22*** | (2006.01) |
| ***A45D 42/00*** | (2006.01) |
| ***B65D 69/00*** | (2006.01) |
| ***B65D 71/00*** | (2006.01) |
| ***A45D 33/00*** | (2006.01) |
| ***A45D 33/18*** | (2006.01) |
| ***A45D 33/20*** | (2006.01) |

(52) U.S. Cl.

CPC ..... *A45D 33/006* (2013.01); *A45D 33/18* (2013.01); *A45D 33/008* (2013.01); *A45D 33/20* (2013.01)

(58) Field of Classification Search

CPC . A45D 33/006; A45D 33/008; A45D 33/025; A45D 33/16; A45D 33/18; A45D 33/20; A45D 33/22; A45D 33/24; A45D 33/26; A45D 2033/001; A45D 40/24; A45C 11/008

USPC ..... 132/295, 286, 287, 291, 293, 294, 296, 132/297, 300, 301, 303, 305, 314–318; 206/581, 823, 235, 503, 504, 508, 509, 206/822; 220/821, 822, 4.23, 4.26, 4.31, 220/4.32, 4.27, 23.6, 23.83; 108/101, 179, 108/139; 312/120, 135; 211/85.2, 98, 173, 211/133.4, 144, 163, 164, 165, 166; D28/77–83

See application file for complete search history.

(56) References Cited

U.S. PATENT DOCUMENTS

| | | | | | |
|---|---|---|---|---|---|
| 3,179,070 | A | * | 4/1965 | Beller | 108/103 |
| 3,188,157 | A | * | 6/1965 | Rand | 312/202 |
| 3,392,868 | A | * | 7/1968 | Pfrommer | 220/520 |
| 4,216,867 | A | * | 8/1980 | Sturm | 211/77 |
| 4,239,308 | A | * | 12/1980 | Bradley | 312/201 |
| 4,289,245 | A | * | 9/1981 | Hasulak | 211/133.4 |
| D267,153 | S | * | 12/1982 | Lebowitz | D19/77 |
| 4,378,116 | A | | 3/1983 | Rubik | |
| 4,560,078 | A | * | 12/1985 | Dubuisson | 220/4.26 |
| 4,807,773 | A | * | 2/1989 | Tsai | 220/4.27 |
| 4,815,483 | A | * | 3/1989 | DuGrenier et al. | 132/295 |

(Continued)

OTHER PUBLICATIONS

"Totally Me" comsetic compact image, retrieved from Internet website prior to Apr. 24, 2013.

(Continued)

*Primary Examiner* — Vanitha Elgart
(74) *Attorney, Agent, or Firm* — Peter Giancana

(57) ABSTRACT

Cosmetic and/or personal care compacts having a multi-tiered design. The tiers are able to rotate relative to each other between defined configurations of the compact. When in any one of its defined configurations, the compact has the same overall shape, for example, a prism. The rotation feature also allows the visual impact of the compact to be varied while maintaining the overall shape of the compact, and is a novelty for a user.

15 Claims, 11 Drawing Sheets

(56) References Cited

U.S. PATENT DOCUMENTS

| | | | | | |
|---|---|---|---|---|---|
| 4,944,402 | A | * | 7/1990 | Wu | 206/581 |
| 5,025,817 | A | * | 6/1991 | Wen | 132/296 |
| 5,033,626 | A | * | 7/1991 | Platti | 211/37 |
| 5,246,020 | A | * | 9/1993 | Wu | 132/295 |
| 5,417,329 | A | * | 5/1995 | Whitman | 206/499 |
| 5,425,971 | A | * | 6/1995 | Chiang-Cheng | 428/28 |
| 5,458,243 | A | * | 10/1995 | McBride | 206/503 |
| 5,799,787 | A | * | 9/1998 | Talbot | 206/315.11 |
| 6,041,935 | A | * | 3/2000 | Yang | 206/581 |
| 6,145,515 | A | * | 11/2000 | Wu | 132/295 |
| 6,223,921 | B1 | * | 5/2001 | Huang | 220/4.27 |
| 6,302,120 | B1 | * | 10/2001 | Kuo | 132/295 |
| 6,378,533 | B1 | * | 4/2002 | Roman | 132/295 |
| 6,439,406 | B1 | * | 8/2002 | Duhon | 211/131.1 |
| 6,540,083 | B2 | * | 4/2003 | Shih | 206/581 |
| 6,619,297 | B2 | * | 9/2003 | Sheng | 132/295 |
| D498,674 | S | * | 11/2004 | Smouha | D6/472 |
| 6,831,541 | B1 | | 12/2004 | Seidler | |
| 6,961,977 | B2 | | 11/2005 | Seidler | |
| 7,055,216 | B2 | | 6/2006 | Seidler | |
| 7,089,627 | B2 | | 8/2006 | Seidler | |
| 7,337,497 | B2 | | 3/2008 | Seidler | |
| 7,467,440 | B2 | | 12/2008 | Seidler | |
| 7,478,500 | B1 | * | 1/2009 | Pollock et al. | 43/54.1 |
| 7,600,756 | B2 | | 10/2009 | Verdes | |
| 7,614,405 | B2 | * | 11/2009 | Allen et al. | 132/295 |
| 7,975,969 | B2 | * | 7/2011 | Jan et al. | 248/125.7 |
| 8,156,948 | B2 | | 4/2012 | Gatesoupe | |
| 8,528,751 | B2 | * | 9/2013 | Klein et al. | 211/73 |
| 2005/0172981 | A1 | | 8/2005 | Byun | |
| 2006/0231116 | A1 | * | 10/2006 | Kaiser et al. | 132/295 |
| 2009/0063166 | A1 | * | 3/2009 | Palmer | 705/1 |
| 2009/0230069 | A1 | | 9/2009 | Naden et al. | |
| 2009/0308408 | A1 | | 12/2009 | Winckels et al. | |
| 2010/0319723 | A1 | * | 12/2010 | Parker | 132/287 |
| 2010/0319724 | A1 | * | 12/2010 | Chung | 132/295 |
| 2011/0253711 | A1 | * | 10/2011 | Hertaus | 220/4.27 |
| 2011/0315648 | A1 | * | 12/2011 | Buttigieg | 211/163 |

OTHER PUBLICATIONS

International Search Report of ISA (KIPO) for PCT application No. PCT/US2014/032652; mailing date: Aug. 8, 2014; completion date: Aug. 8, 2014.

Written Opinion of the ISA (KIPO) for PCT application No. PCT/US2014/032652; mailing date: Aug. 8, 2014; completion date: Aug. 8, 2014.

* cited by examiner

MULTI-LAYERED COMPACTS WITH ROTATING TIERS

FIELD OF THE INVENTION

The present invention is in the field of cosmetic compacts that store color products, personal care products, implements for applying product and/or other articles.

BACKGROUND AND DEFINITIONS

A cosmetic compact is a portable storage container for color products, personal care products, implements for applying product and/or other articles. The most common features of a cosmetic compact include a cover, a base connected to the cover through a hinge; a latch mechanism to hold the cover on the base in a closed position, a means for operating the latch mechanism, one or more compartments in the base for holding one or more cosmetic products or related articles. Cosmetic compacts are usually sized to fit conveniently into a handbag, and held in the hand when in use.

OBJECTIVES OF THE INVENTION

A main object of the invention is a cosmetic and/or personal care compact in a multi-tiered design, wherein the tiers are able to rotate relative to each other, for novelty or for one or more practical purposes, and wherein in two or more configurations of the tiers, the compact has an overall shape of a prism.

SUMMARY

We disclose cosmetic and/or personal care compacts having a multi-tiered design. The tiers are able to rotate relative to each other between three or more defined configurations of the compact. When in any one of its defined configurations, the compact has the same overall shape, for example, a prism. The sides of each tier hold one or more elements, such as cosmetic or personal care items or decorative features. Rotation of the tiers allows a user to gather various elements on one side of the compact. The rotation feature also allows the visual impact of the compact to be varied while maintaining the overall shape of the compact, and is a novelty for a user. Preferably, the interior of the top tier is accessible and may be used to store a consumer product, one or more applicators and/or some other article.

DETAILED DESCRIPTION

We first describe the invention in terms of a three tiered compact whose defined configuration is a cube. Then we generalize the discussion to other numbers of tiers and shapes.

1st Embodiment: A Three-tiered Cube Compact

Figure 1:
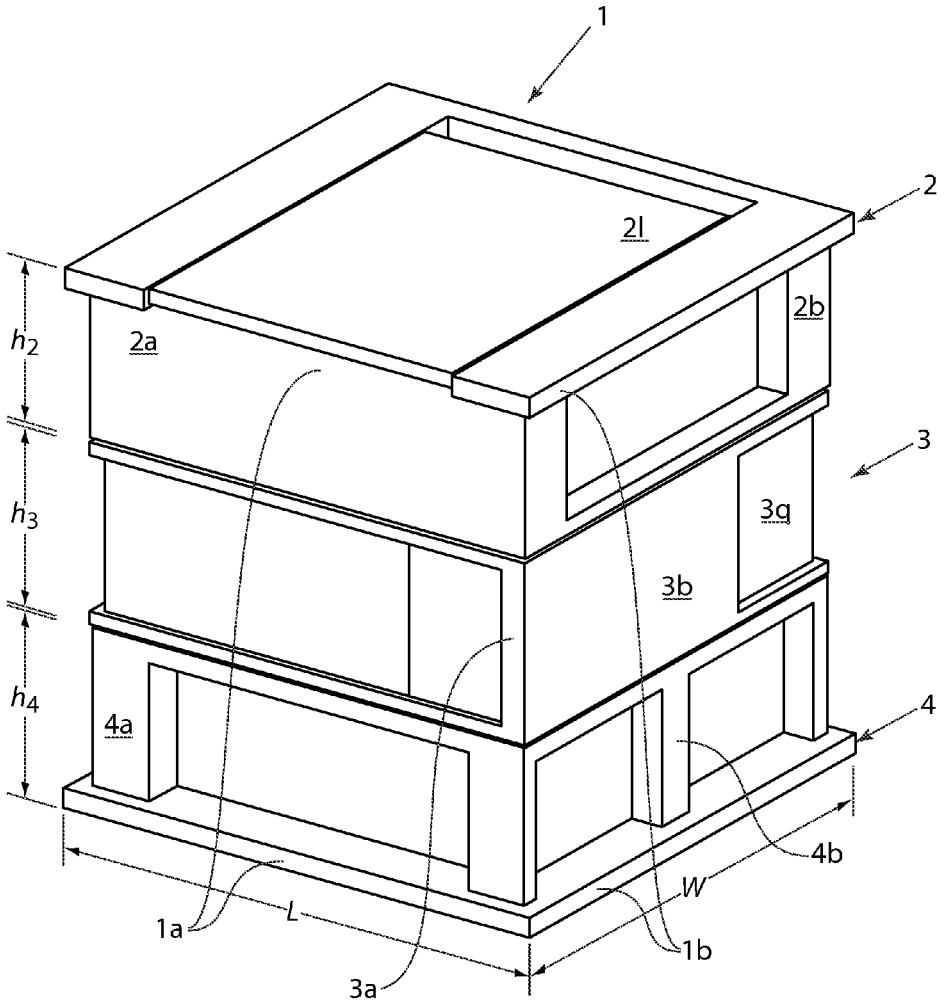
FIG. 1 is a perspective view of a three tiered compact having four lateral faces with multiple recesses, according to one embodiment of the present invention.
Figure 2:
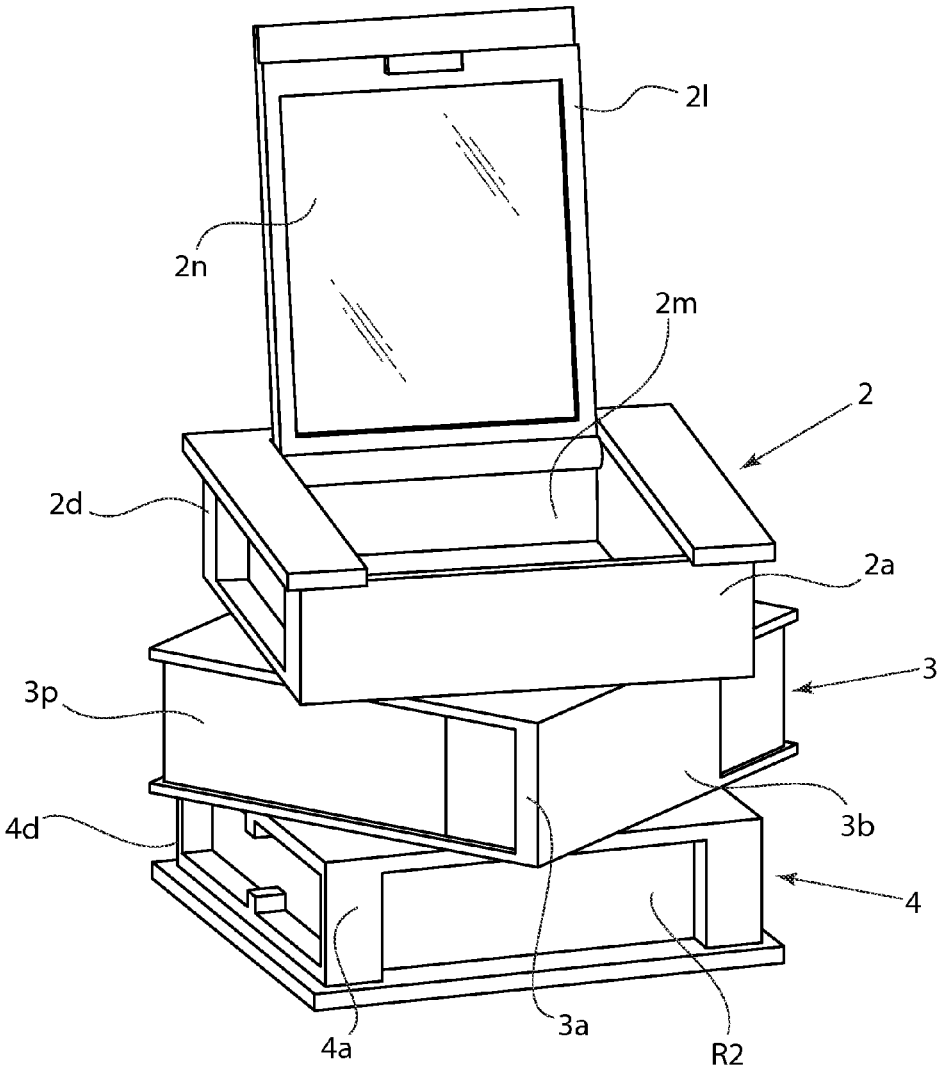
FIG. 2 shows the compact of FIG. 1 with the tiers relatively rotated.
Figure 3:
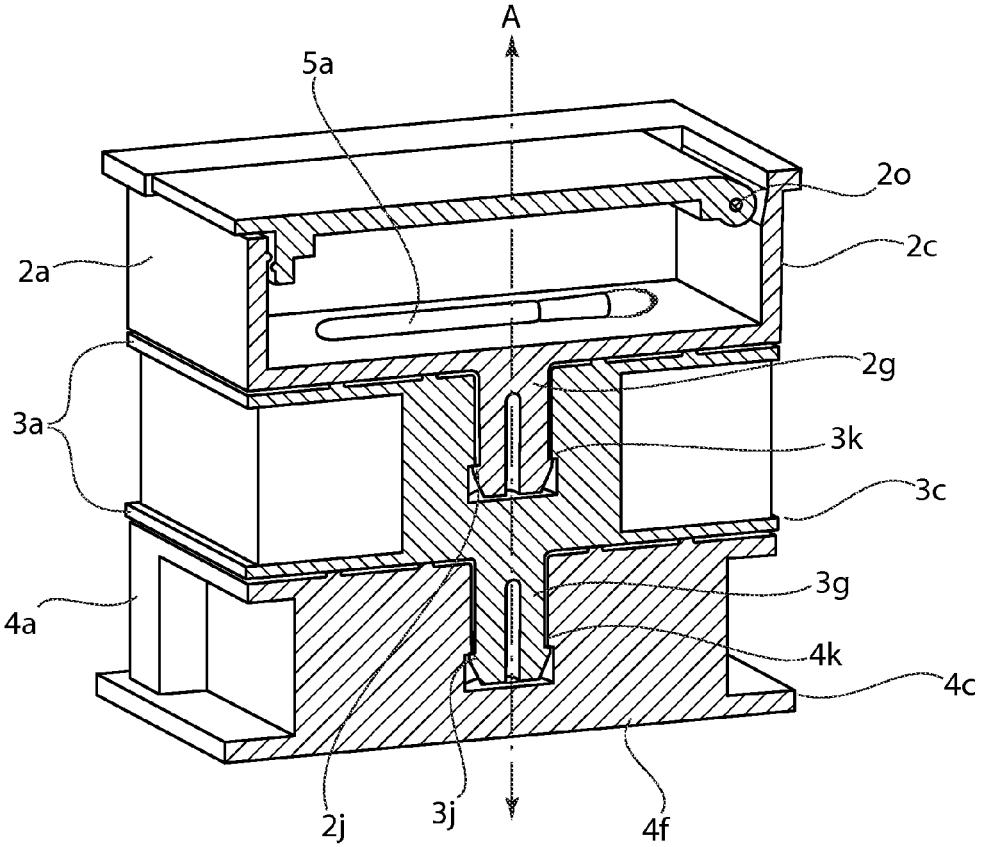
FIG. 3 is a vertical cross section of the compact of FIG. 1, showing the rotation mechanism, and interior o the top tier.
Figure 4:
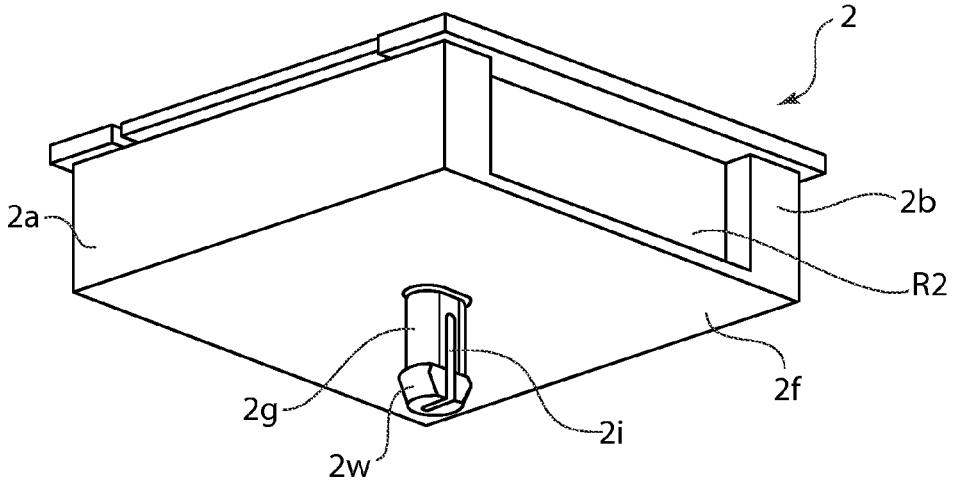
FIG. 4 is a perspective view of the bottom and two lateral faces of the top tier of the compact of FIG. 1.
Figure 5:
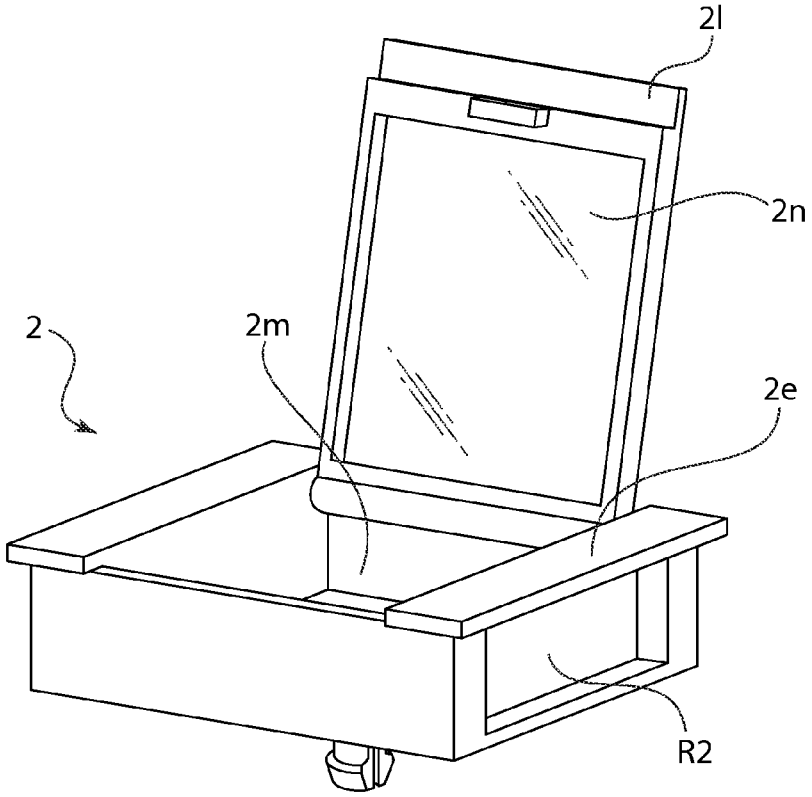
FIG. 5 is a perspective view of the top thereof.
Figure 6:
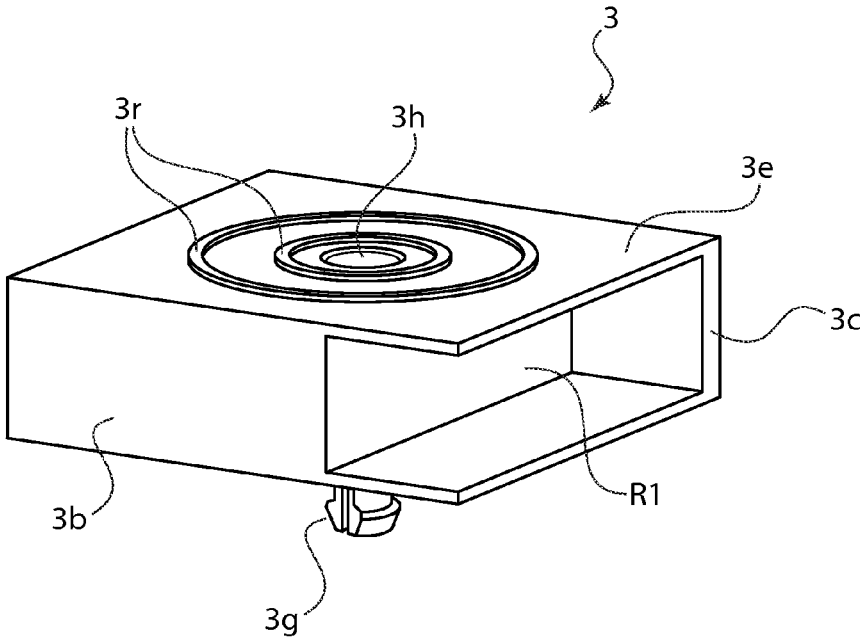
FIG. 6 is a perspective view of the top and two lateral faces of the middle tier of the compact of FIG. 1.
Figure 7:
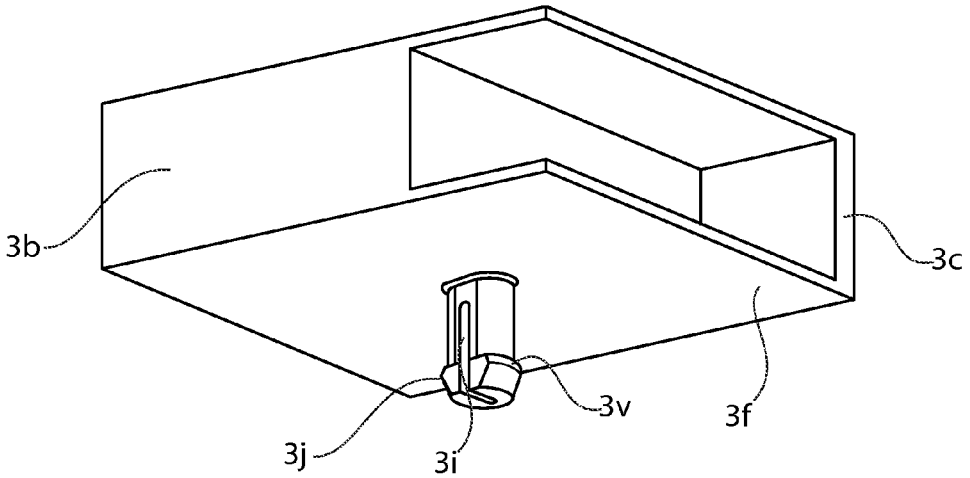
FIG. 7 is a perspective view of the bottom thereof.
Figure 8:
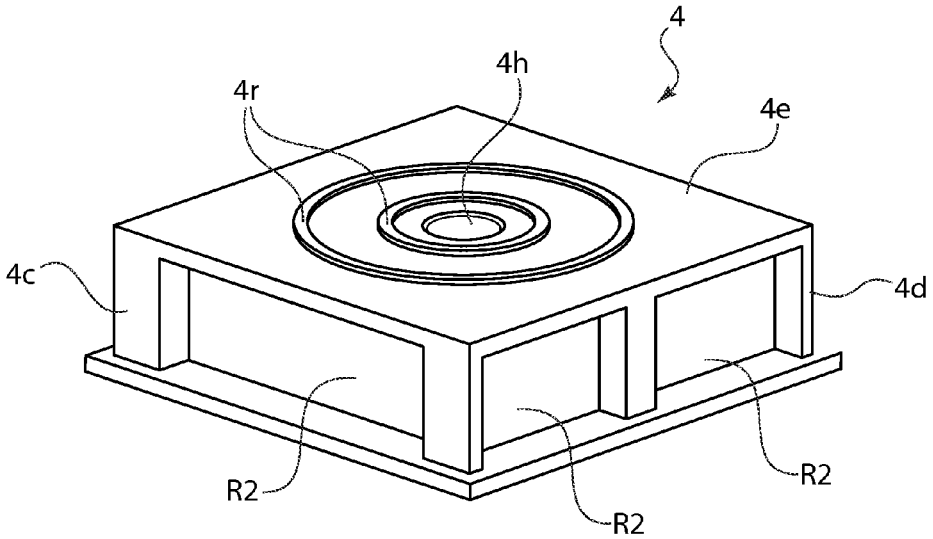
FIG. 8 is a perspective view of the bottom tier and two lateral faces of the compact of FIG. 1.

The compact (1) shown in FIGS. 1-3 has a top tier (2), a middle tier (3) and a bottom tier (4). Reference numbers 1*a*-1*d* denote the lateral faces of the assembled compact, but we will also speak of the lateral faces of each tier. For example, the top tier has lateral faces (2*a*-2*d*), the middle tier has lateral faces (3*a*-3*d*), and the bottom tier has lateral faces (4*a*-4*d*). Furthermore, each tier has a top surface (2*e*, 3*e*, 4*e*) and a bottom surface (2*f*, 3*f*, 4*f*). Each lateral face has a length, L, and a width, W, which are also the length and width of the assembled compact. Each tier has its own height, i.e. $h_2$, $h_3$, $h_4$. The height of the assembled compact is H, which is approximately equal to $h_2+h_3+h_3$. To achieve an overall cube shape, L=W=H, or approximately so. In some preferred embodiments, the 3 tiers have the same height (that is, $h_2=h_3=h_4$ or approximately so), which provides a clean, pleasing geometric appearance, but this is not required.

Rotation of the Tiers

At least some of the tiers (2, 3, 4) are able to rotate in either direction, relative to the other tiers (see FIG. 2), so that the lateral faces (1*a*-1*d*) of the assembled compact are changeable. Preferably, all of the tiers (in this case, three tiers) are able to rotate relative to the other tiers (in this case two tiers). The number of different lateral faces of the compact of FIG. 1 is 64, and the number of defined configurations of the compact is 16. Throughout the specification, a "defined configuration" of the cube compact is any arrangement of the tiers wherein the assembled compact has the shape of a cube. Thus, the compact as shown in FIG. 1 is in a defined configuration, and the compact of FIG. 2 is not in a defined configuration. We say that in FIG. 2, the compact is in-between two defined configurations. In general, the tiers rotate between defined configurations, and each defined configuration presents a consumer with a different visual experience, although in all defined configurations, the compact of FIG. 1 is a cube.

In order to increase the number of defined configurations, all tiers are able to rotate around a central axis of rotation, A, that passes through the centers of all the tiers. In compacts according to the invention, there is one and only one (i.e. exactly one) such axis of rotation. FIG. 3 illustrates one mechanism that enables the relative rotation of adjacent tiers. Pins (2*g*, 3*g*) depend from the bottom sides (2*f*, 3*f*) of the top and middle tiers (2, 3) into channels (3*h*, 4*h*) located in the top sides (3*e*, 4*e*) of the adjacent middle and bottom tiers, respectively. The pins and channels are coaxial and located along central axis (A), so that, starting from a defined configuration, every turn of 90° returns the compact to a defined configuration (i.e. a cube shape). In a less preferred embodiment (not shown), pins could have been made to rise up from the top-sides (3*e*, 4*e*) of the middle and bottom tiers (3, 4) into channels in the bottom sides (2*f*, 3*f*) of the top and middle tiers, respectively, but then the interior space (2*m*) of the top tier would be interrupted by the channel. The three tiers are shown in more detail in FIGS. 4-8.

Preferably, each pin is a retaining pin, and forms a positive retaining engagement in an adjacent channel. By this we mean that a retaining pin can easily slide into a cylindrical channel, but not be removed easily, nor accidentally removed in normal use. For example, in FIGS. 3 and 4, the retaining pin (2*g*) may be split longitudinally by a slot (2*i*), and the distal end of the pin may be provided with a shoulder (2*j*) and tapered portion (2*w*). The shoulder width is a little larger than the channel dimension. However, the bottom of the tapered portion is a little smaller than the channel dimension, and when the retaining pin is inserted into the channel, the slot allows the shoulder width to reduce until the shoulder passes a retaining edge (3*k*) located down in the channel (see FIG. 3). Once the shoulder passes the retaining edge, the shoulder expands and the retaining edge prevents the retaining pin from being accidentally removed from the channel. This retaining feature must be implemented such that the retaining pin is able to rotate in the channel. For example, the retaining pin and the channel may both be cylindrical or approximately so. An entirely similar arrangement may be used to create the engagement between the middle tier (3) and the bottom tier (4).

Separation of the Tiers

In one optional, but preferred embodiment, at least some of the adjacent tiers of the compact are able to be deliberately separated. This feature allows tiers to be removed from the compact, and/or new tiers to be added to the compact. It also allows the tiers of a compact to be rearranged, and it allows a user to carry only the tiers that she plans to use. Thus, we may provide some means of overcoming the positive retaining engagement between adjacent tiers. In one embodiment (see FIG. 7) the shoulder (3*j*) of retaining pin (3*g*) is declined from horizontal at (3*v*). The degree of decline is sufficient that when the middle (3) and bottom (4) tiers are pulled apart, the retaining pin width will reduce to allow the shoulder to rise above the retaining edge (3*k*), which itself, may be inclined above horizontal to further facilitate the separation. From there, the two tiers may be completely separated.

The Upper and Lower Surfaces of the Tiers

The top tier (2) has an upper surface (2*e*) that serves as the upper surface of the assembled compact (1). Because the upper surface does not support another tier, the shape of the upper surface is not restricted in that way. However, when the compact is to convey the idea of a regular geometric shape, such as a cube, the upper surface of the top tier should be approximately flat. Optionally, the upper surface of the top tier may be provided with one or more covers (2*l*) that provide access to an interior space (2*m*) of the top tier when the cover is in its opened position, but not when the cover is in its closed position. A cover may be implemented according to any known mechanism, such as a hinged engagement (2*o*), sliding engagement (not shown), swivel engagement (not shown), etc. The interior space may be used to house a cosmetic or personal care product or applicator (5*a*), or any other item that can fit into the space. For example, the underside of the cover may be provided with a mirror (2*n*) for use in applying makeup. For a hinged engagement, it is preferable if the cover can be rotated through an angle of at least 90° from its closed position, so that the mirror is upright and accessible.

The bottom tier (4, FIG. 8) has a lower surface (4*f*) that serves as the lower surface of the assembled compact (1). Because the compact is intended to sit on this surface, it may be preferable for the lower surface to be sufficiently flat to allow the compact to rest securely. Like the upper tier, an interior space of the bottom tier may be accessible through a cover, this one provided in the lower surface of the bottom tier. Optionally, the upper surface (4*e*) of the bottom tier may be provided with one or more rings (4*r*) that are concentric with the channel (4*h*) that has already been described. If the rings are present, then the middle tier (3) would rest on the concentric rings of the bottom tier, and slide smoothly thereon. The rings are intended to provide a smoother movement of the middle tier relative to the bottom tier.

The middle tier (3, FIGS. 6-7) has an upper surface (3*e*) that is substantially like the upper surface (4*e*) of the bottom tier (4). That is, the upper surface of the middle tier has a channel (3*h*), and may have one or more concentric rings (3*r*) that serve the same purpose as described for the bottom tier (4). The middle tier also has a lower surface (3*f*) that is substantially like the lower surface (2*f*) of the upper tier (2). That is, a retaining pin (3*g*) depends from the bottom face of middle tier. This retaining pin (3*g*) is like the retaining pin (2*g*) described above, and is formed so that it can easily slide into cylindrical channel (4*h*) of the bottom tier (4), but not be removed easily, nor accidentally removed in normal use. For example, the retaining pin may be split longitudinally by a slot (3*i*), and the distal end of the retaining pin may be provided with a shoulder (3*j*). The shoulder width is a little larger than the channel dimension. However, when the retaining pin is inserted into the channel, the slot allows the shoulder width to reduce until the shoulder passes a retaining edge (4*k*) located down in the channel (see FIG. 3). Once the shoulder passes the retaining edge, the shoulder expands and the retaining edge prevents the retaining pin from being removed from the channel.

In a cube compact, two adjacent tiers may be arranged in four different configurations such that the lateral sides of two adjacent tiers are parallel. Preferably, one or more hard stops are provided that are engaged when the lateral sides of two adjacent tiers are parallel. For example, in the adjacent tiers shown in FIG. 12, the top surface (30*e*) of a lower tier (30) may have one or more bumps (30*s*), and the bottom surface (20*f*) of an upper tier (20) may have one or more dimples (20*t*) that are able to register with the bumps when the lateral faces of the lower tier are parallel to the lateral faces of the upper tier. During relative rotation of adjacent tiers, one or more bumps of the lower tier will come to rest in one or more dimples of the upper tier, thus letting the user know where to stop rotating the tiers. Only light pressure is required to move the bumps out of the dimples when a user wants to change the configuration of the compact. The stop feature is for purely aesthetic reasons, for when the compact is not in use. Other types of stop mechanisms will be readily apparent to a skilled artisan.

The Recessed Lateral Faces of the Tiers

In the assembled compact (1), there are 12 lateral faces (2*a*-2*d*), (3*a*-3*d*), (4*a*-4*d*). In some preferred embodiments of the invention, portions of the lateral faces are recessed. The number of recesses in each lateral face is only limited by the overall size of the lateral faces. In FIG. 1, the compact is designed with 10 recesses of two types (R1, R2) in the lateral faces (only six are visible in FIG. 1). Also in FIG. 1, some of the lateral faces have one recess that fills most of the lateral face, and some have two recesses. However, there may be more than two recess in a lateral face, if desired. Recesses of type (R2) are confined within a single lateral face, while recesses of type (R1) extend to the end of the lateral face and open up onto an adjacent lateral face.

The shape of each recess in the lateral faces is not restricted. However, when the compact is intended to convey a particular idea or visual theme, then it may be preferable (although not required) to form the recesses in a shape that is consistent with that idea or theme. For example, in the cube compact shown in FIG. 1, the recesses in the lateral faces are rectangular (which includes square). The four sided, straight-edged recesses reinforce the cube theme of the assembled compact.

The recesses may be used to house products, applicators, personal care articles, purely decorative elements (8), or some other items. At least some of the recesses house at least one product, applicator, personal care article and/or purely decorative element. Examples of non-product articles include applicators (i.e., brush, comb, sponge), mirror, tweezers, clippers, scissors, etc. Purely decorative elements include real or faux gems, and surfaces (such as metal, plastic, rubber or wood) that may or may not have pictures, text or other design elements displayed thereon or incorporated therein. Preferably, at least half of the recesses hold cosmetic or personal care products, more preferably, at least 70% of the recesses hold cosmetic or personal care products, most preferably, at least 90%.

A cosmetic or personal care product may be disposed directly into a recess or it may be disposed in a receptacle which is the housed in a recess. Broadly, there are two types of product receptacles; those that remain in the recess during use of the compact, and those that must be removed from the recess before using. Receptacles that remain in the compact may be housed in either type of recess, (R1) or (R2), but for aesthetic reasons it is preferable to place them in one of the recesses (R2) that is confined within a single lateral face. Receptacles that are removed from the compact are preferably housed in the type of recess (R1) that that has at least one end that extends to the end of the lateral face and opens up onto an adjacent lateral face. This facilitates removing the receptacle from the recess.

Figure 9:
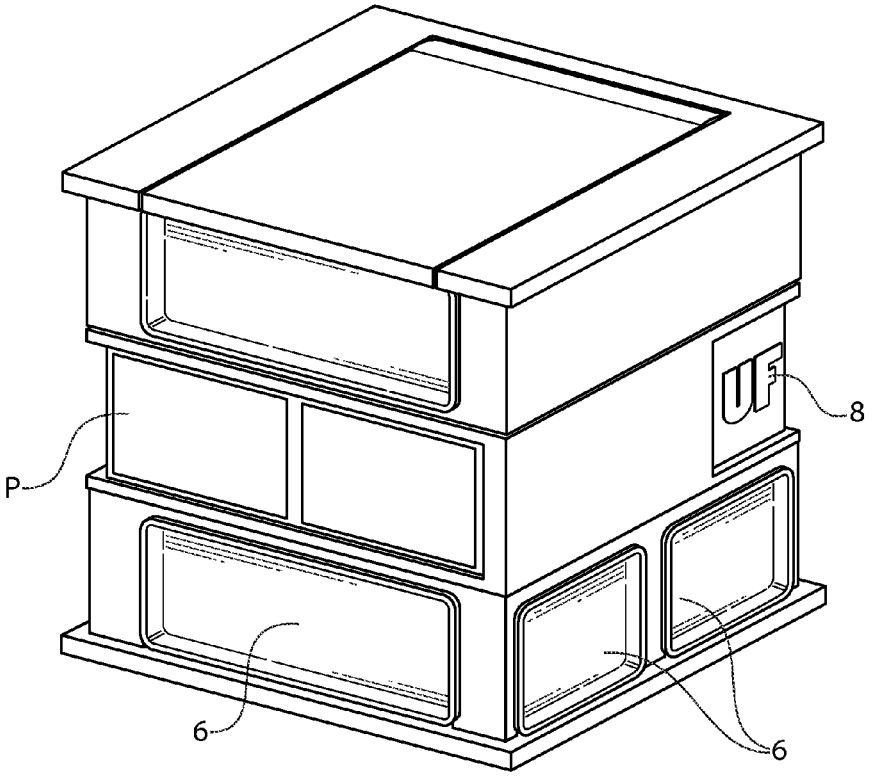
FIG. 9 shows a compact according to the invention with product receptacles fixed in some of the recess of the lateral faces.
Figure 10:
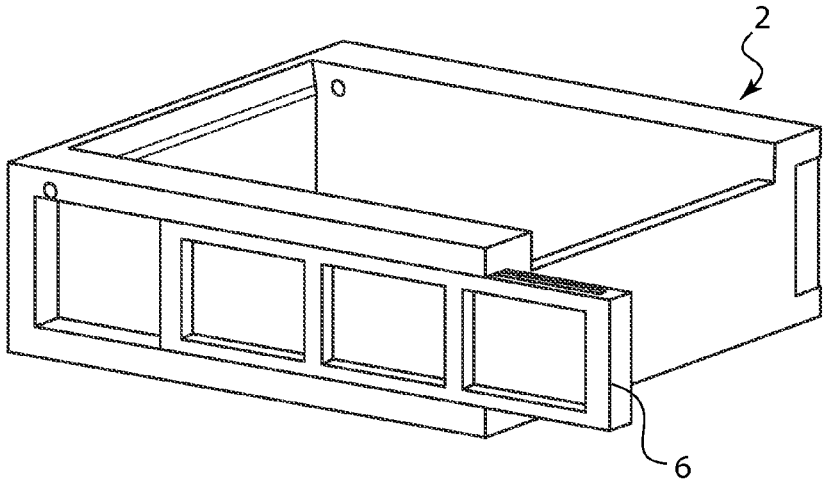
FIG. 10 shows a tier with a removable product receptacle that slides along a lateral face of the tier.

An example of a stay-in-place product receptacle is a pan (6) filled with cosmetic or personal care product (P, see FIG. 9), such as a pressed powder, thick gel or cream, solid hot poured product, baked product, other compacted product, etc. Because the pan of product remains in the compact during use, an applicator must be used to extract product from the pan. A pan may be filled according to known methods in the art, and then secured into a recess of the compact, so that it remains in the recess during normal use of the compact. As shown in FIG. 9, a single pan may fill up a recess, or more than one pan may occupy the same recess, side-by-side. Alternatively, one unitary pan may be divided into multiple segments, as in FIG. 10. The pans may be glued in place in the recess, but to make the compact reusable it may be preferable to use a removable pan. For example, the pan may use a snap fit or friction fit engagement in the recess, that allows a user to remove the pan. Another removable pan is shown in FIG. 10, which depicts a pan (6) that slides in and out of a lateral face of a top tier (2). This way, when product is used up, a pan may be easily replaced. In the drawings, the pans are shown as lying on their sides in a relatively shallow recess, but when the recess is deeper, a pan may also lay in an upright position.

In contrast, examples of product receptacles that must be removed from the compact before use include those receptacles that have their own unique dispensing system, such as a lipstick riser (3*p*), and those that require a very effective airtight seal and/or utilize a wiper component, such as a mascara container (3*q*). These types of receptacles must be removed from the recess in order to access the product. When not in use, the removable product receptacle is held in the recess by a snap fit or friction fit or any suitable means. When the product in this type of receptacle is depleted, it may easily be replaced with a fresh one.

Covers for the Recesses

We define the "upright orientation" of the compact in space to mean that the bottom tier (4) is horizontal, and is the tier that is closest to the ground. Even in the upright orientation of the compact, it is important to make sure that the product contained in a recess (of type R2, for example) is not be able to leak out. The present invention contemplates recesses with and without covers (7) (see FIG. 11). A cover for a recess (R2) provides access to the interior of the recess when the cover is in an opened position, but not when the cover is in a closed position. When a recess does not have a cover, the types of products or related articles that may be stored in the recess are limited to those that are not adversely affected by being exposed to the air or that are already fully contained in a separate receptacle (i.e. a lipstick or mascara container). On the other hand, for a "loose" product (i.e. one that is not fully contained in a separate container), the recess should be provided with a cover (7). Preferably, the cover is able to make a seal that is effective to prevent loose product from leaking out of the recess. Preferably, each recess that houses a loose product has its own cover, so that a consumer may choose to open one or more recesses at a time.

Figure 11:
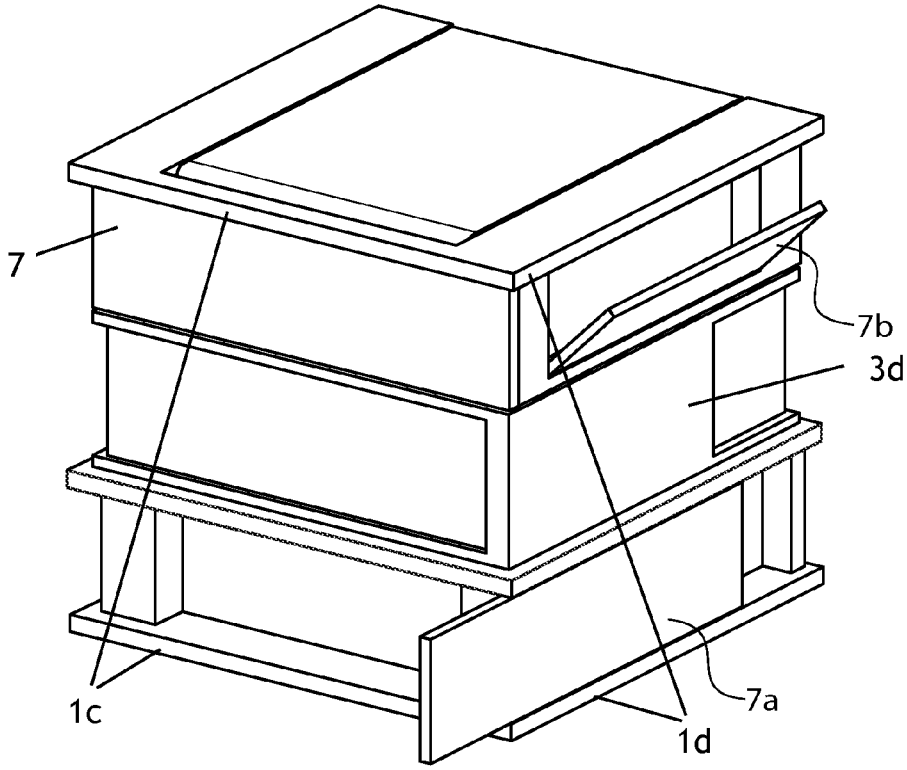
FIG. 11 shows covers on some of the recesses of the lateral faces.

Suitable covers (7) include those that snap fit over or into the recess opening. Alternatively, the cover (7*a*) may slide across the opening of the recess, in one or more grooves. Another option is to provide a hinged articulation for the cover (7*b*) in combination with a snap or friction fit into the opening of the recess. The hinged articulation may cause the over to open laterally or vertically (as shown in FIG. 11). Certain of these elements may also be combined. For example, a sliding cover may also have a hinge feature, such that when one end of the cover slides to the corner of the tier, the cover may then be pivoted back against the adjacent lateral face. Also, some covers may remain attached to the compact, even in the opened position, while some covers may be completely separated from the compact when the recess is opened. At a minimum, the cover should protect the product in the recess from contamination. Certain products may not require the cover to be fluid tight. These may include products that will not flow or fall out of the recess. Such products might include pressed powders, thick gels and creams, hot pours, baked products, etc. Preferably, however, the cover provides a fluid tight seal when such would lengthen the shelf life of the product. Furthermore, a fluid tight seal may be essential for products that would otherwise leak out of the recess. Many liquids, lotions, and loose powers, etc. are not suitable for storing in a recess without a fluid tight cover.

In some preferred embodiments one or more covers (7) of the recesses of the lateral faces are transparent, preferably clear, so that the color of the product within the recess can be seen. In some preferred embodiments, all of the covers are clear. When products of various colors show through the clear covers, a significant visual impact is created.

Optional Features and Alternatives Embodiments

Figure 12:
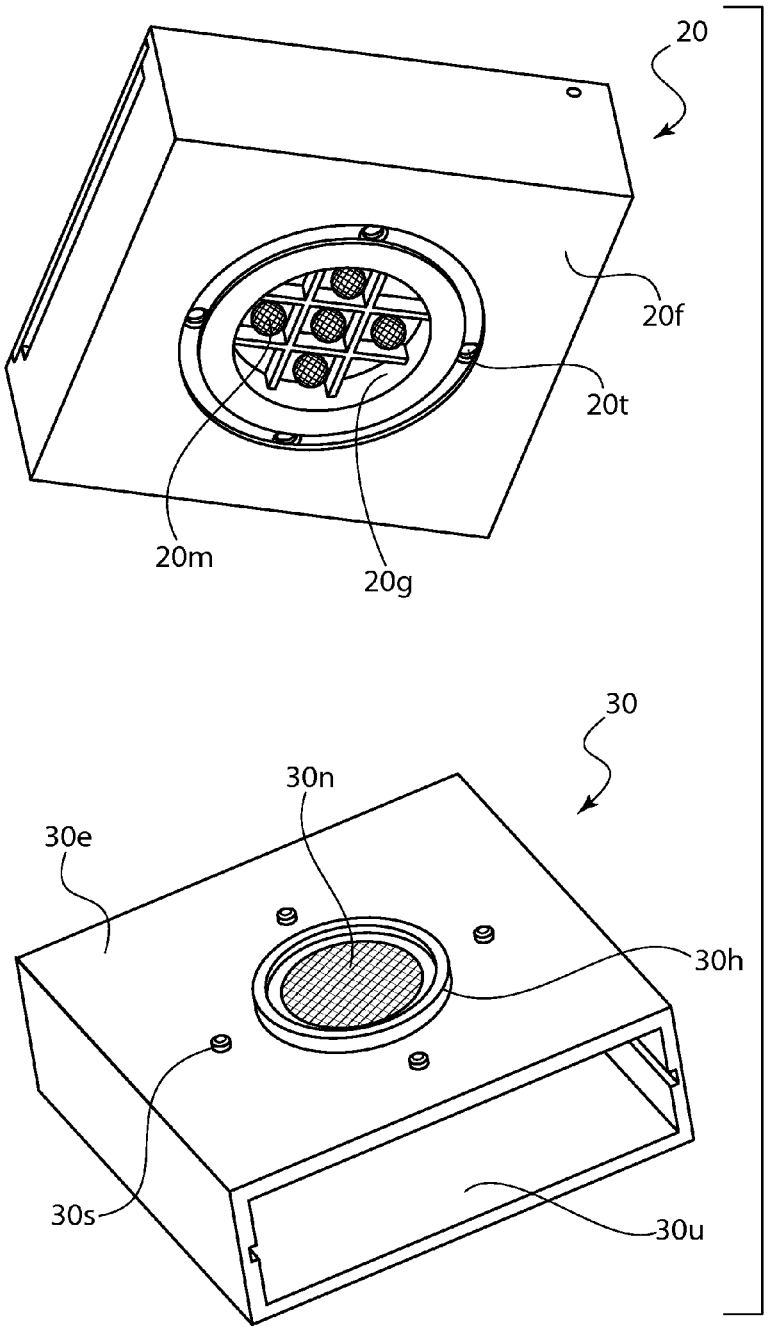
FIG. 12 represents two separated tiers that may be joined with magnets.

FIG. 12 illustrates one alternative positive retaining engagement between tiers, that enables the relative rotation of adjacent tiers around an axis of rotation (A) that passes through the centers of the tiers. In this set of embodiments, a force of magnetic attraction holds adjacent tiers together. The attraction is sufficiently strong so that the tiers of the compact do not separate under the weight of the compact, but a user is able to separate adjacent tiers by overcoming the magnetic force of attraction. For example, two adjacent tiers of a compact are shown in FIG. 12, disassembled. A cylindrical recess (20*g*) is located in the bottom surface (20*f*) of an upper tier (20), and is designed to receive a circular feature (30*h*) that arises from the upper surface (30*e*) of an adjacent lower tier (30). The cylindrical recess and circular feature are coaxial with an axis of rotation (A). The circular feature just fits inside the cylindrical recess, and is able to rotate therein. One or more magnets (20*m*) is located at the bottom of the cylindrical recess, and one or more magnetic or ferromagnetic elements (30*n*) is fixed within the circular feature. The force of attraction between magnet(s) (20*m*) and magnetic or ferromagnetic element (30*n*) is sufficiently strong to keep the two tiers of the compact together when the compact is used normally. However, the tiers could be separated deliberately if a user overcomes the magnetic force of attraction. As, noted above, one reason that a user may want to separate a tier from the compact is so that she does not have to carry the whole compact with her if she only plans to use one tier of the compact. Also, a user may want to remove one tier and/or add another tier to the compact, or reorganize the tiers of the compact. In this embodiment, the tiers can be more easily separated than in the retaining pin embodiment, described above. Furthermore, when separated form the main compact, the tier with magnetized cylindrical shaft presents a cleaner, more trimmed appearance than the tier with axial retaining pin (2*g*).

Figure 13:
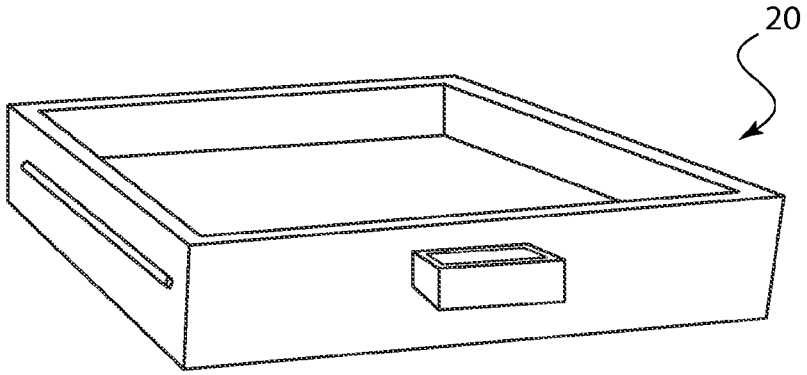
FIG. 13 is a storage drawer that is able to slide in and out of a lateral face of a tier.

Compacts according to the present invention may comprise one or more sliding drawers, which may be used for storing any item that will fit into the drawer. For example, FIG. 13 shows a sliding storage drawer (9) which may be housed in the lower tier (30), in interior space (30*u*) depicted in FIG. 12. As shown, the drawer is approximately as wide as the lateral face of the lower tier. However, a drawer may be narrower than the lateral face. Also, more than one drawer may be housed in the same lateral face of the same tier.

Generalized Discussion: Other Embodiments

Up to now we have described a compact that is a stack of three tiers that have a square horizontal cross section of the same size. However, compacts of the invention are not limited to three tiers. The number of tiers may be chosen based on a need to keep the overall package small, so that it is still perceived as a cosmetic compact, as the term "compact" is perceived in the art. A preferred cosmetic compact fits easily into a women's purse or handbag, and fits conveniently in one hand while being used. For example, for most cosmetic compacts, the largest linear dimension is less than about six inches, many less than four inches, and often less than two inches. Within that preferred limitation, a compact of the invention may have two or more tiers. On the other hand, a compact with just two tiers is not as visually interesting, and not as much fun to use, as a compact with at least three tiers. Thus, a preferred compact according the invention has at least three tiers, more preferably from three to six tiers, but even more preferably exactly three tiers. However, in principle, there may be more than six tiers, such as 7 to 12 tiers, especially if the construction is to serve as more of a portable carrier than a cosmetic compact for a handbag.

Again, in the discussion that follows, compacts according to the invention are limited to those in which the axis of rotation passes through the centers of all tiers.

The shape on the individual tiers and the number of tiers dictate the overall shape of the compact. Theoretically, the shape of the assembled compact is not limited. However, well defined geometric shapes are preferred. Up to now, we have described tiers having the same overall size and shape. While this may be preferred, it is not essential. For the following discussion, we say that two tiers are similar if the shape of their horizontal cross sections is the same. If the horizontal cross sections are also the same size, then the two tiers are congruent.

Figure 14:
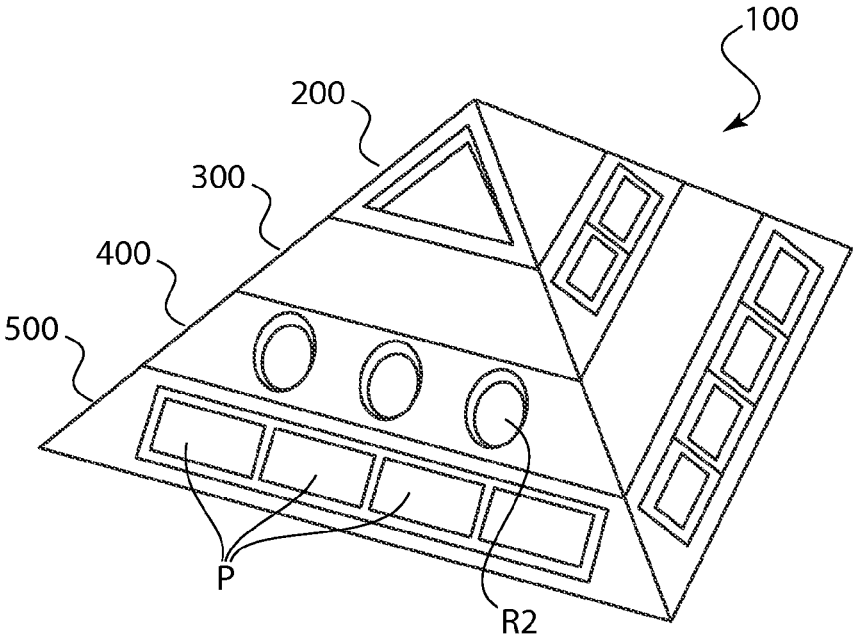
FIG. 14 is a compact according to the present invention in the shape of a pyramid.

When the horizontal cross sections of all of the tiers are similar, but not all are congruent, then the width of a stack of tiers changes with height. For example, the overall shape of the compact may be pyramidal. FIG. 14 shows a pyramid compact (100) with four tiers (200, 300, 400, 500). In stacking the tiers to make a pyramidal compact, the lateral faces of the tiers may be angled away from vertical so that the sides of the pyramid are smooth (as shown), or the lateral faces may be vertical so that the pyramid steps in, as you move up the compact (not shown). Another example of a compact having a well defined shape, built up with tiers of different sizes, is a compact in the shape of the platonic solids tetrahedron, octahedron, dodecahedron and icosahedron. Of course, a cube compact described above is the fifth platonic solid, but the horizontal cross sections of its tiers are congruent.

In more preferred compacts of the present invention, the horizontal cross sections of the tiers are the same size and shape. More preferably that shape is polygonal whose sides have lengths $L_1$, $L_2$, $L_3$, etc. One example of this may be seen in a rectangular compact of the present invention. However, in the most preferred case, the shape of the tiers is that of a regular polygon (i.e. equilateral triangle, square, regular pentagon, regular hexagon, regular heptagon, regular octagon, regular polygon with from nine to twenty sides, etc.) whose sides all have length L. When the horizontal cross section of all tiers have the same size and shape of a regular polygon, and the axis of rotation passes through centers of the tiers, then the overall shape of the compact is, generically, a regular, right prism. To make a right prism compact, the lateral faces of the tiers must be perpendicular to their horizontal cross sections. In the case of a regular right prism compact, a "defined configuration" is any arrangement of the tiers in which the overall shape of the compact is that of a regular, right prism. If each tier of a regular, right prism compact has a number of lateral faces, N, then, starting from a defined configuration, every turn of one or more tiers by 360°/N, returns the compact to a defined configuration (i.e. the regular, right prism). For example, a five sided regular right prism compact would return to a defined configuration after a tier is rotated 72°; 60° for a six sided compact; 45° for an eight sided compact, etc.

In preferred embodiments, all tiers of a compact are able to rotate relative to all other tiers of the compact. In this case, if each tier of the regular, right prism compact has a number of lateral faces, N, and if the number of tiers in the compact is $\tau$, then there are $N^{(\tau-1)}$ "defined configurations" of the compact, and there are $N^{\tau}$ unique lateral faces of the compact.

For example, the cube compact described above is a regular right prism compact having 3 tiers, each tier with four lateral faces. The number of defined configurations of the compact is $4^{(3-1)}=16$, and there are $4^3=64$ unique lateral faces of the compact.

For example, an equilateral triangular right prism compact with two tiers, has $3^{(2-1)}=3$ defined configurations, and there are $3^2=9$ unique lateral faces of the compact. However, an equilateral triangle compact had four tiers, there would be $3^{(4-1)}=27$ defined configurations, and $3^4=81$ unique lateral faces.

Figure 15:
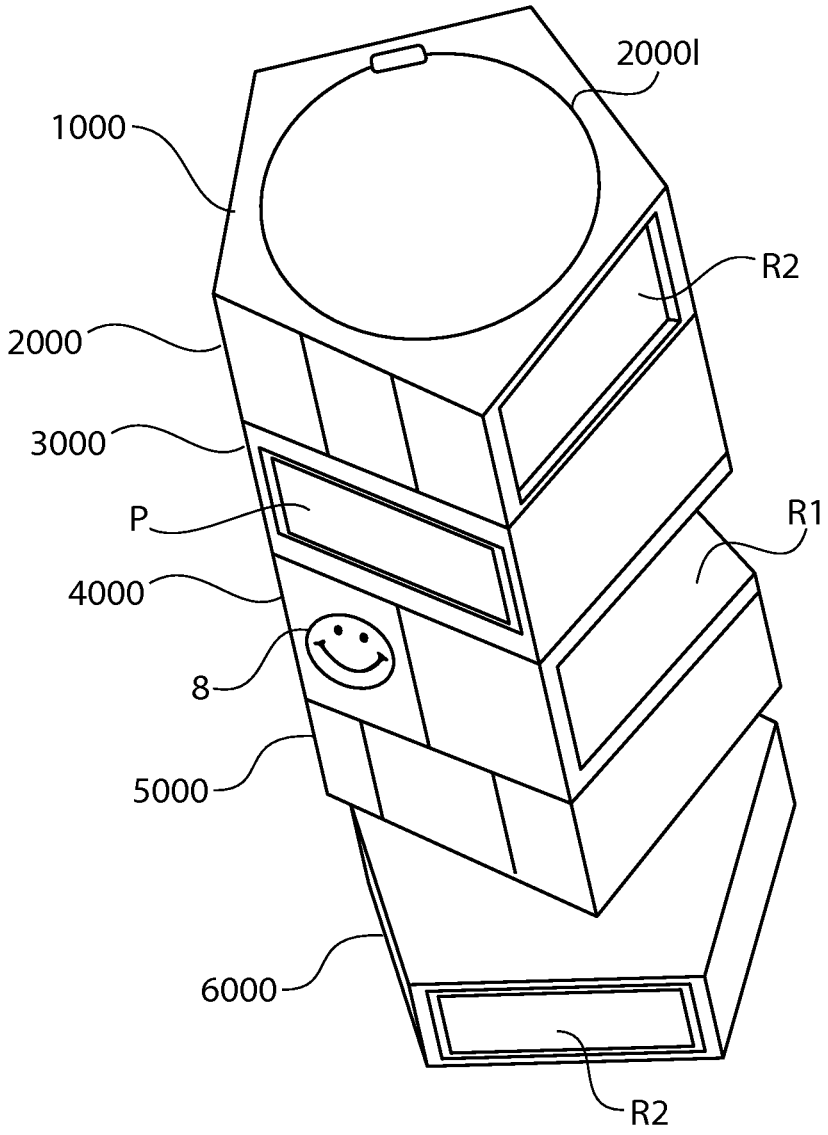
FIG. 15 is a compact according to the present invention in the shape of a pentagonal prism.

For example, a two tiered pentagonal right prism compact would have $2^{(5-1)}=16$ defined configurations, and $2^5=32$ unique lateral faces. In contrast, a five tiered pentagonal right prism compact (1000) is shown in FIG. 15, with cover (20001) on top tier (2000), and two types of recess (R1, R2). Bottom tier (6000) is shown as relatively rotated with respect to the other tiers. This compact would be capable of $5^{(5-1)}$=625 defined configurations, and $2^5$=3125 unique lateral faces. That is a very large number of unique "looks" to present to a consumer while keeping the overall shape of the compact unchanged.

Figure 16:
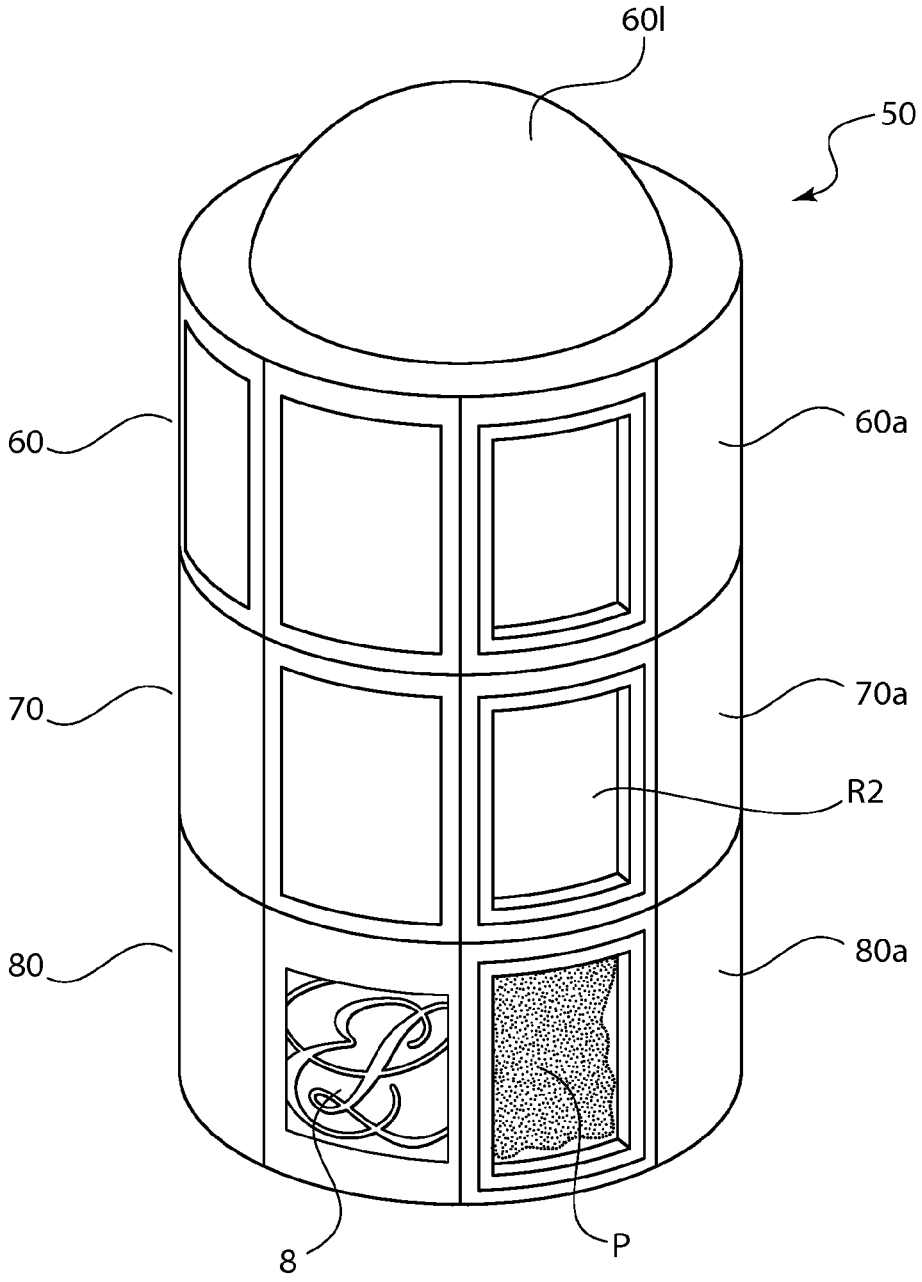
FIG. 16 is a compact according to the present invention in the shape of a cylinder.

Up to now we have described a compact that is a stack of three tiers wherein the tiers comprise flat lateral faces. However, the principles of the present invention may be applied to compacts built up from tiers that have zero flat lateral faces, or a combination of flat and non-flat lateral faces. An example of a multi-tiered compact (50) with zero flat lateral faces is a stack of tiers (60, 70, 80) of circular horizontal cross section and an axis of rotation that passes through the centers of the tiers (FIG. 16). Here each tier has a top surface, a bottom surface, and one lateral face (60*a*, 70*a*, 80*a*). Top tier (60) has a cover (601) that gives access to an interior space of the top tier. At least some of the lateral faces have one or more recesses (R1) that house at least one product (P), applicator, personal care article, purely decorative element or combinations thereof. If the circumferences of all of the tiers are equal, then the overall appearance of the compact is a cylindrical. In such a compact, there may be any number of defined configurations. The mechanisms for joining tiers and effecting rotation are substantially as described above.

That a consumer can easily modify her compact to achieve so many looks while keeping the shape of the compact unchanged, is a novel and unexpected feature of the invention.

What we claim is:

1. A cosmetic compact that has an overall shape, comprising a stack of at least three tiers, each tier having:

a polygonal horizontal cross section, a center, a top surface, a bottom surface, and a number of lateral faces having the same height; wherein at least some adjacent tiers form a positive retaining engagement;

at least some of the tiers are enabled to rotate relative to other tiers around exactly one axis of rotation (A), which passes through the centers of all the tiers;

the enabled tiers rotate between three or more defined configurations of the compact, such that when the compact is in any one of its defined configurations, the compact has the same overall shape; and at least some of the lateral faces have one or more recesses that house at least one product, applicator, personal care article, purely decorative element or combinations thereof.

2. A cosmetic compact according to claim 1 wherein all of the horizontal cross sections of the tiers are similar, but not all are congruent.

3. A cosmetic compact according to claim 2 wherein the overall shape of the compact is that of a pyramid or platonic solid.

4. A cosmetic compact according to claim 1 wherein all of the horizontal cross sections of the tiers are congruent.

5. A cosmetic compact according to claim 1 wherein the horizontal cross sections are rectangular or regular polygonal.

6. A cosmetic compact according to claim 5 wherein the overall shape of the compact is that of a right regular prism.

7. A cosmetic compact according to claim 6 wherein the overall shape of the compact is a cube.

8. A cosmetic compact according to claim 1 wherein the number of tiers in the stack is from three to six.

9. A cosmetic compact according to claim 1 wherein the top and/or bottom tier of the stack of tiers comprises a cover and an interior space, such that the cover provides access to the interior space when the cover is in its opened position, but not when the cover is in its closed position.

10. A compact according to claim 1 wherein the positive retaining engagement between adjacent tiers comprises a retaining pin that depends from the bottom surface of one tier into a channel located in the top surface of an adjacent tier, and wherein the retaining pin may be removed from the channel by a user.

11. A compact according to claim 1 wherein the positive retaining engagement between adjacent tiers comprises a force of magnetic attraction that holds adjacent tiers together, and wherein the tiers may be separated by a user.

12. A compact according to claim 1, wherein at least some of the recesses house a pan of cosmetic or personal care product.

13. A compact according to claim 1, wherein at least some of the recesses house a product receptacle that may be removed from the recess prior to use and returned to the recess after use.

14. A compact according to claim 1, wherein at least some of the recess have a cover that provides access to the interior of the recess when the cover is in an opened position, but not when the cover is in a closed position.

15. The compact of claim 14 wherein the covers of the recesses are clear.

* * * * *